US006116861A

United States Patent [19]

Hogan et al.

[11] Patent Number: 6,116,861

[45] Date of Patent: Sep. 12, 2000

[54] FILTER ASSEMBLY WITH JET PUMP NOZZLES

[75] Inventors: Terrence D. Hogan, Saline; Robert Edward Rhein, Ypsilanti, both of Mich.

[73] Assignee: General Motors Corporation, Detroit, Mich.

[21] Appl. No.: 09/327,357

[22] Filed: Jun. 7, 1999

[51] Int. Cl.[7] ..... F04B 23/00; F04B 49/00; E03B 5/00

[52] U.S. Cl. ..... 417/313; 417/307; 137/896

[58] Field of Search ..... 417/313, 307, 417/309; 137/565.35, 896

[56] References Cited

U.S. PATENT DOCUMENTS 5,292,234 3/1994 Ling ..... 417/309
5,778,756 7/1998 Haga et al. ..... 91/441
5,802,848 9/1998 McClendon et al. ..... 60/426

*Primary Examiner*—Timothy S. Thorpe
*Assistant Examiner*—Michael K. Gray
*Attorney, Agent, or Firm*—Laura C. Wideman; Michael J. Bridges

[57] ABSTRACT

A pump and filter assembly including a filter housing secured in a pump housing. The filter housing has a filter outlet portion with a central filter outlet passage. A plurality of nozzle passages are disposed adjacent and radially outward of the filter outlet passage. The nozzles communicate with an annular recess formed in the filter outlet portion. The annular recess receives return bypassed hydraulic fluid from a regulator valve for distribution through the nozzles into an inlet stream of fluid flowing through the filter outlet passage. The inlet stream velocity is increased which increases the pressure at the pump inlet. The increased pressure at the pump inlet allows the pump to operate at higher speeds without cavitation.

4 Claims, 2 Drawing Sheets

FILTER ASSEMBLY WITH JET PUMP NOZZLES

TECHNICAL FIELD

This invention relates to pump assemblies having a filtered inlet and more particularly to filter assemblies having means for elevating the inlet pressure at the pump.

BACKGROUND OF THE INVENTION

Positive displacement hydraulic pumps often operate at variable speeds especially when the pump is in a vehicle power steering system or a vehicle automatic transmission. The pump is driven by the vehicle engine and therefore must operate through the entire engine speed range. The speed at which the pump is driven can exceed 6000 rpm. When the pump speed is high, cavitation may occur at the pump inlet.

In power steering systems such as that shown in U.S. Pat. No. 5,802,848, it is known to position a nozzle in line with a venturi tube to improve the inlet pressure condition of the pump. The power steering system, however, does not employ a filter at the pump inlet. Automatic transmissions, on the other hand, do position a filter element in serial flow relation upstream of the pump inlet. The filter element is known to provide a flow restriction. The sump is typically at atmospheric pressure. Therefore, the pressure available to fill the pump chambers is typically atmospheric pressure minus the pressure drop across the filter.

SUMMARY OF THE INVENTION

It is an object of the present invention to provide an improved pressure and flow condition at a filtered pump inlet.

In one aspect of the present invention, a filter element is disposed in serial flow relation with a pump inlet port, and a multiple nozzle arrangement is positioned between the filter element and the pump inlet. In another aspect of the present invention, the filter and the nozzle structure are formed in a single assembly.

In yet another aspect of the present invention, the assembly of the filter and nozzle structure is secured in a housing, which has a pump, inlet passage and a hydraulic fluid return passage. In still another aspect of the present invention, the fluid return passage forms an annular chamber around the nozzle structure to communicate fluid through the nozzle openings prior to delivery to the pump inlet. In a further aspect of the present invention, the nozzle structure has a plurality of nozzle openings disposed about the outer periphery of a filter outlet passage in the filter and nozzle assembly.

DESCRIPTION OF AN EXEMPLARY EMBODIMENT

Figure 1:
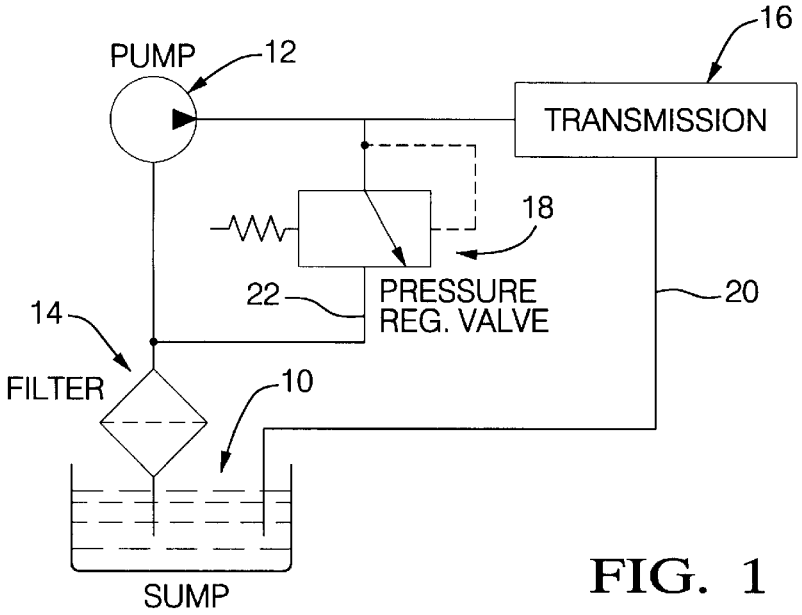
FIG. 1 is a schematic diagram of a portion of a hydraulic system incorporating the present invention.

Referring to the drawings wherein like characters represent the same or corresponding parts through the several views, there is seen in FIG. 1 a schematic representation of a sump or reservoir 10 which contains hydraulic fluid. A transmission control pump 12 draws fluid from the reservoir

10 through a filter and nozzle assembly 14. The pump 12 delivers pressurized hydraulic fluid to a conventional transmission and control system 16. The maximum pressure at the pump outlet is determined by a conventional pressure regulator valve 18, which delivers excess pump flow to the filter and nozzle assembly 14. As is well known with conventional regulator valves used with transmissions, the fluid first satisfies the transmission requirements, then satisfies the torque converter requirements, then supplies some lube and cooling and finally returns the excess fluid to the pump inlet or a filter assembly. With the present invention, the excess fluid is delivered to a filter and nozzle assembly 14.

The lube flow and leakage in the transmission and control 16 is returned to the reservoir 10 through passages such as 20. The excess flow from the pressure regulator valve 18 is delivered to the filter and nozzle assembly 14 through a bypass passage 22. The excess fluid leaves the pressure regulator valve 18 with increased velocity and at an elevated pressure, which is higher than the pressure at the reservoir 10.

Figure 2:
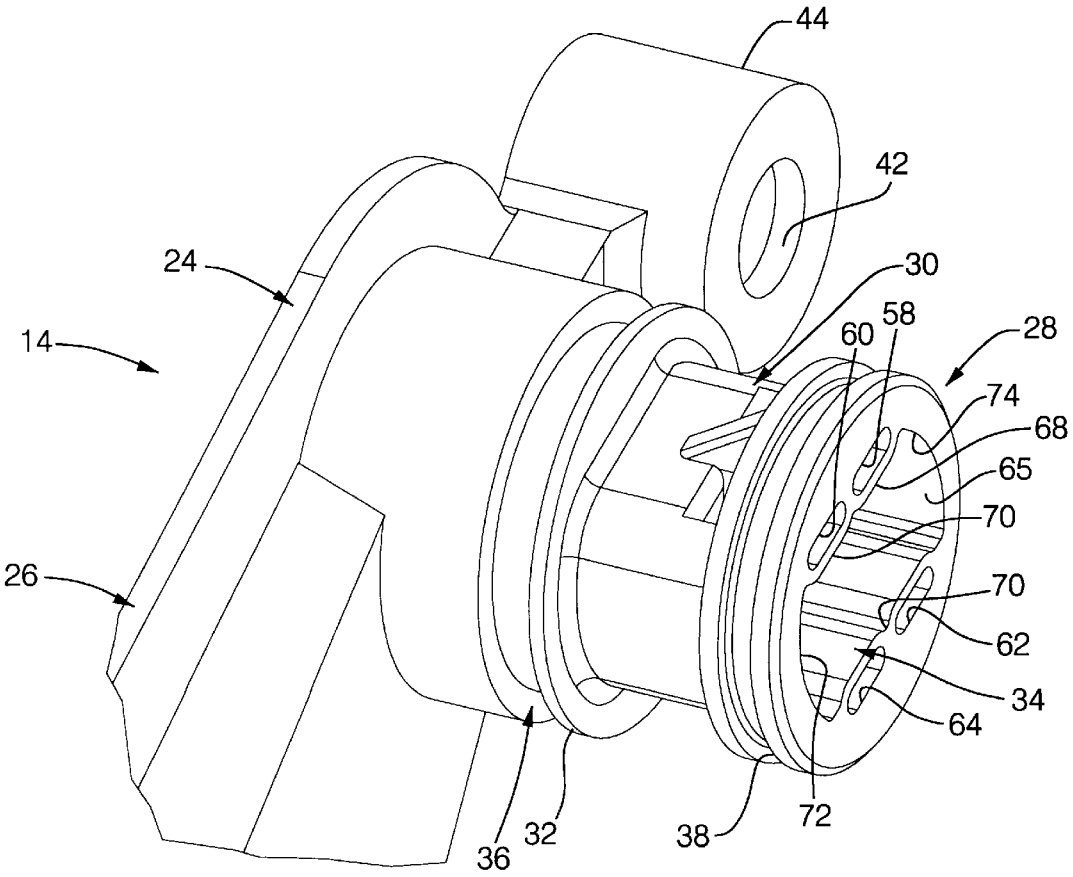
FIG. 2 is an isometric view of a portion of a filter and nozzle assembly incorporating the present invention.

The filter and nozzle assembly 14, FIG. 2, has a housing 24 which has a filter element 26 secured therewith. The filter element is located continually below the level of the fluid in the reservoir 10. The pressure of the fluid in the reservoir 10 is at atmospheric level. A filter outlet portion 28 extends substantially perpendicular from the housing 24. All of the hydraulic fluid, which enters from the reservoir 10, passes through the filter element 26. The filter outlet portion 28 has a substantially annular recess 30 formed about an outer wall 65 of a filter outlet passage 34. The filter outlet flow passage 34 is formed internally of the filter outlet portion 28. All of the fluid passing through the filter element 26 also passes through the passage 34.

Figure 3:
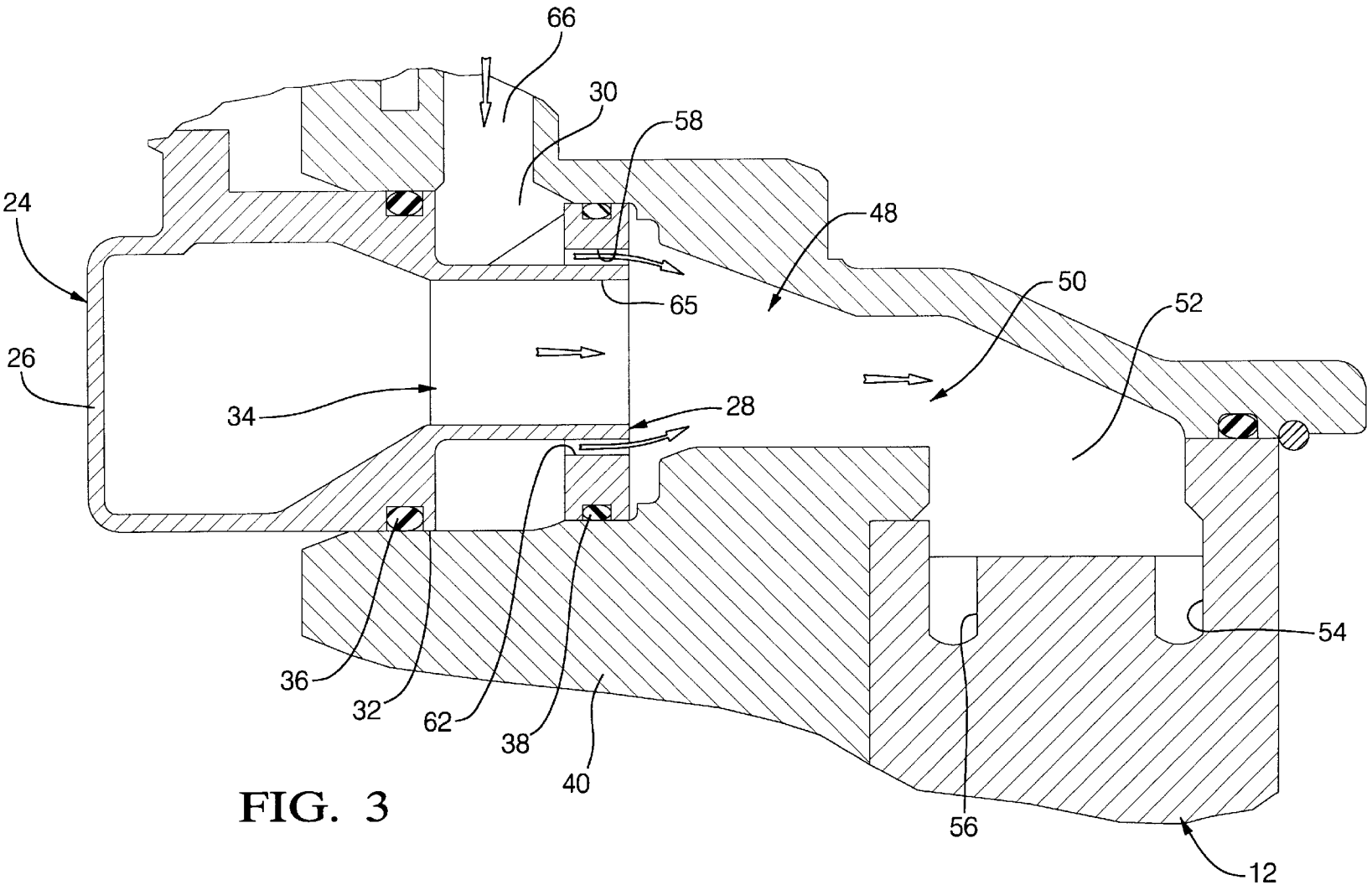
FIG. 3 is a sectional view of a portion of a pump and assembly shown in FIG. 2.

A pair of seal grooves 36, 38 are formed adjacent the annular recess 30 on an outer periphery 32. As best seen in FIGS. 2 and 3, the filter housing 24 is secured in a pump housing 40. One or more fasteners, not shown, are inserted through openings, such as 42, in bosses, such as 44, to retain the filter and nozzle assembly 14. The filter outlet portion 28 is positioned in a pump inlet bore 48 such that the hydraulic fluid leaving the passage enters the pump inlet bore 48. The inlet bore 48 reduces in diameter to form an inlet passage throat 50 downstream of the filter outlet portion 28. The inlet passage throat 50 communicates with a pump inlet plenum 52, which is disposed in fluid communication with inlet ports 54, 56 of the transmission control pump 12. As is well known, the pump 12 is a displacement device which draws fluid in through the inlet ports 54, 56 and delivers pressurized fluid through outlet ports, not shown.

The filter outlet portion 28 has a plurality of nozzle passages 58, 60, 62 and 64 which communicate hydraulic fluid from the annular recess 30 to the inlet bore 48. The nozzles 58, 60, 62, and 64 are formed in the filter outlet portion 28 between the outer periphery 32 and the outer wall 65 of the filter outlet flow passage 34. The nozzles 58, 60, 62 and 64 communicate fluid from the annulus 30 to the pump inlet bore 48. Fluid enters the annular recess 30 through a passage 66 in the pump housing 40. As is common with transmission control pumps, the pressure regulator valve 18 is housed in or near the pump housing 40. The passage 66 is directly connected with the bypass passage 22. The hydraulic fluid, which is bypassed at the pressure regulator valve 18, enters the annular recess 30 and is accelerated through the nozzle passages 58, 60, 62, and 64 to an increased velocity. This fluid leaves the nozzle passages 58, 60, 62, and 64 and enters the fluid stream at the juncture of the filter outlet passage 34 and the pump inlet bore 48.

Due to the high velocity of the fluid leaving the nozzle passages 58, 60, 62, and 64, the velocity of the fluid in the passage 34 is increased. As is well known, when the velocity of a fluid increases, the pressure decreases. Thus, the pressure differential across the filter 26 is increased such that more fluid from the reservoir 10 will be induced to pass through the filter 26 than would occur without the pressure change caused by the flow through the nozzles passages 58, 60, 62, and 64. The fluid velocity is also increased at the inlet passage throat 50, further enhancing the inlet flow to the pump 12.

As the hydraulic fluid enters the pump inlet plenum 52, the velocity decreases and the pressure accordingly increases, thereby creating a supercharge pressure at the pump inlets 54, 56. The increased pressure at the pump inlets 54, 56 increases the cavitation speed of the pump, thereby decreasing the operating noise level at high pump speeds.

The filter and nozzle assembly 14 is preferably a molded unit. By incorporating the nozzle passages 58, 60, 62 and 64 in the filter and nozzle assembly 14 in a single unit, the size and location of the nozzle passages 58, 60, 62 and 64 are held to close tolerances during manufacture and the assembly is produced at conventional production rates. In the exemplary embodiment shown in FIG. 2, the filter outlet passage 34 is substantially oblong with elongated sides 68, 70 and rounded ends 72, 74. The nozzle passages 58 and 60 are formed adjacent the long side 68, and the nozzles 62 and 64 are formed adjacent the long side 70. This arrangement is believed to provide efficient mixing of the return fluid from the annular recess 30 and the inlet flow from through the filter 26. Other design configurations of the filter and nozzle assembly 14 are possible.

The integral molding of the filter and nozzles insures the consistent positioning of the nozzles relative to the inlet passage, thereby reducing the need for inspection operations at assembly and variances between transmission assemblies. The nozzle passages cannot be misassembled relative to the filter outlet passage 34 and the pump inlet bore 48. The jet pump action of the nozzle passages 58, 60, 62 and 64 result in a higher pressure at the pump inlet than exists at the filter inlet, thereby improving the pump output flow and the cavitation speed.

What is claimed is:

1. A pump and filter assembly comprising:

a pump housing having a pump inlet bore and a fluid return passage; and a filter and nozzle assembly having a filter element and a filter outlet portion located downstream of said filter and partially extending in said pump inlet bore in said pump housing, said filter outlet portion including an annular recess disposed in fluid communication with said fluid return passage, a filter outlet passage concentric with and radially inward of said annular recess and being in fluid communication between said filter and said pump inlet bore and a plurality of nozzle means communicating with said return passage for delivering fluid to and mixing fluid with a fluid stream exiting said filter outlet passage to increase the fluid pressure level at a pump inlet to a value greater than the pressure level at said filter.

2. The pump and filter assembly defined in claim 1 further comprising:

said nozzle means comprised of multiple nozzle passages disposed adjacent and radially outward of said filter outlet passage.

3. The pump and filter assembly defined in claim 2 further comprising:

said filter outlet passage having elongated side walls and rounded end walls and two of said nozzle passages being disposed adjacent one of said elongated side walls and the other two nozzles being disposed adjacent the other of said elongated side walls.

4. A pump and filter assembly comprising:

a pump housing having a pump inlet bore and a fluid return passage;

a filter and nozzle assembly disposed in a transmission fluid reservoir, said filter and nozzle assembly having a filter element and a filter outlet portion located downstream of said filter and partially extending in said pump inlet bore in said pump housing, said filter being immersed in the fluid in the transmission reservoir, said filter outlet portion including an annular recess disposed in fluid communication with said return passage, a filter outlet passage concentric with and radially inward of said annular recess and being in fluid communication between said filter and said pump inlet bore and a plurality of nozzle means communicating with said return passage for delivering fluid to and mixing fluid with a fluid stream exiting said filter outlet passage, said fluid communicating with said pump inlet bore; and a throat portion formed in said pump housing downstream of said pump inlet bore and being effective to further increase the velocity of said fluid to thereby increase the fluid flow through said filter and to induce a fluid pressure level at a pump inlet to a value greater than the pressure level at said filter.

* * * * *